US005831226A

United States Patent [19]

Hattori et al.

[11] Patent Number: 5,831,226

[45] Date of Patent: Nov. 3, 1998

[54] GROUP-CONTROLLED ELEVATOR SYSTEM

[75] Inventors: Kazuhiro Hattori, Yamato; Atsunori Kondo, Kawasaki, both of Japan

[73] Assignee: Otis Elevator Company, Farmington, Conn.

[21] Appl. No.: 763,175

[22] Filed: Dec. 10, 1996

[30] Foreign Application Priority Data

May 29, 1996 [JP] Japan ..... 8-134030

[51] Int. Cl.[6] ..... B66B 1/20; B66B 1/18

[52] U.S. Cl. ..... 187/382; 187/383; 187/389

[58] Field of Search ..... 187/382, 383, 187/384, 389

[56] References Cited

U.S. PATENT DOCUMENTS

| | | | |
|---|---|---|---|
| 3,493,922 | 2/1970 | Laas | 340/19 |
| 4,600,087 | 7/1986 | Tsuji | 187/29 R |
| 4,711,324 | 12/1987 | Schroder | 187/135 |
| 4,718,520 | 1/1988 | Schroder | 187/127 |
| 4,792,019 | 12/1988 | Bittar et al. | 187/125 |
| 4,804,069 | 2/1989 | Bittar et al. | 187/121 |
| 4,836,336 | 6/1989 | Schroder | 187/121 |
| 4,846,311 | 7/1989 | Thangavalu | 187/125 |
| 4,847,728 | 7/1989 | Youla | 361/159 |
| 4,870,334 | 9/1989 | Iwawa et al. | 318/432 |
| 4,915,197 | 4/1990 | Schroder | 187/121 |
| 4,939,634 | 7/1990 | Schroder | 364/141 |
| 4,979,594 | 12/1990 | Begle et al. | 187/121 |
| 4,991,694 | 2/1991 | Friedli | 187/127 |
| 5,065,846 | 11/1991 | Schroder | 187/127 |
| 5,086,883 | 2/1992 | Schroder | 187/127 |
| 5,092,431 | 3/1992 | Schroder | 187/127 |
| 5,183,981 | 2/1993 | Thangavelu | 187/128 |
| 5,192,836 | 3/1993 | Schroder | 187/126 |
| 5,300,739 | 4/1994 | Bittar | 187/127 |
| 5,305,198 | 4/1994 | Schroder et al. | 364/402 |
| 5,317,114 | 5/1994 | Pullela et al. | 187/128 |
| 5,382,761 | 1/1995 | Amano | 187/383 |
| 5,460,245 | 10/1995 | Bittar | 187/383 |
| 5,480,005 | 1/1996 | Bittar | 187/383 |
| 5,612,519 | 3/1997 | Chenais | 187/382 |

OTHER PUBLICATIONS

R.S. Phillips, "Electronic Lifts", Third Edition, 1951, pp. 254–256, 1951.

*Primary Examiner*—Robert Nappi

[57] ABSTRACT

Multiple elevators are installed as a group in a building and are equipped with destination floor boarding location buttons (7), (8), (9) and (10) that are provided on the lobby floor. Multiple car controllers (1), (2), (3), (4) and (5) are input car data for each elevator so that the controllers control the operations of each elevator. A higher level controller (6) is provided with input data from the multiple car controllers and call data and that efficiently operates multiple cars while accommodating changes in traffic demand. When it is determined that higher level controller (6) is in service, all the floors are divided up into sectors and cars are quickly dispatched to the aforementioned sectors in response to the aforementioned destination floor boarding calls, and the sequencing of service in each sector will be in the order in which each destination floor boarding call has occurred.

4 Claims, 2 Drawing Sheets

GROUP-CONTROLLED ELEVATOR SYSTEM

TECHNICAL FIELD

The present invention efficiently operates and controls multiple elevators as a group in response to changes in traffic demand, and in particular it pertains to an elevator system that reduces congestion while in service.

BACKGROUND OF THE INVENTION

In modern buildings, group-controlled elevators in which multiple elevators are controlled as one group have been installed to operate these elevators. These group-controlled elevators are equipped with multiple car controllers into which are input data from each elevator car and that control the operation of each of these cars, and with a higher level controller into which are input data from these multiple car controllers and call data and that efficiently operates each of these multiple cars while accommodating changes in traffic demand. When a call occurs on a certain floor, the higher level controller calculates the time in which each car can respond to the aforementioned call and then assigns the car that can respond most rapidly to the aforementioned call.

When it is determined that the higher level controller is in service, however, rather than group control in the normal mode described above, group control in the peak demand mode is performed. All service floors (floors on which cars respond to destination floor calls initiated on the lobby floor) are assigned to (N−1) cars remaining when 1 car is subtracted from N total cars. For example, as shown in FIG. 3, 15 service floors are assigned to four cars (A), (B), (C) and (D), when one car (E) is subtracted from five cars (A), (B), (C), (D) and (E). The second through the fifth service floors are designated the first sector, the sixth through the ninth service floors are designated the second sector, the tenth through the twelfth service floors are designated the third sector, and the thirteenth through the fifteenth service floors are designated the fourth sector.

Here, when a destination call for floor 7 is produced on the lobby floor, since the seventh floor is part of the second sector, passengers board car (B) on the lobby floor and the car is rapidly dispatched to floor 7. Next, when destination calls occur in the order floor 14, floor 3 and floor 11, cars (D), (A) and (C) are rapidly dispatched in that order to floor 14, floor 3 and floor 11 from the lobby floor. Therefore, once the sector service order is carried out in the order of sectors 2, 4, 1 and 3 (2-4-1-3) in this way, it will subsequently be carried out in the same order.

Accordingly, when destination floor boarding calls occur in the order floor 7, floor 14, floor 3, and floor 11 on the lobby floor, and the next is for floor 11 (the third sector), the elevators are not able to respond to this call immediately because the sector service order is 2-4-1-3. The higher level controller recognizes that there was no destination floor call for the second, fourth or first sectors. Passengers wanting to go from the lobby to floor 11 have to wait.

DISCLOSURE OF THE INVENTION

It is an object of the present invention to provide a group-controlled elevator system in which, when a peak demand mode is established during servicing, passengers in the lobby will not be kept waiting for a long period of time.

In accordance with the present invention, a group-controlled elevator system controls a plurality of elevator cars disposed in a building having a plurality of floors. The group-controlled elevator system comprises: a destination floor input device for receiving destination calls; a plurality of elevator controllers for controlling the operation of the plurality of elevator cars in response to the destination calls; and a group controller responsive to data provided by said plurality of elevator controllers such that the plurality of floors are formed into sectors and the plurality of elevator cars are dispatched to the sectors in response to the destination calls wherein service is provided to the sectors in an order that corresponds to an order of the destination calls.

BEST MODE FOR CARRYING OUT THE INVENTION

The present invention will be explained below with reference to FIGS. 1 and 2 which show an application example of a group-controlled elevator system according to the present invention.

Figure 1:
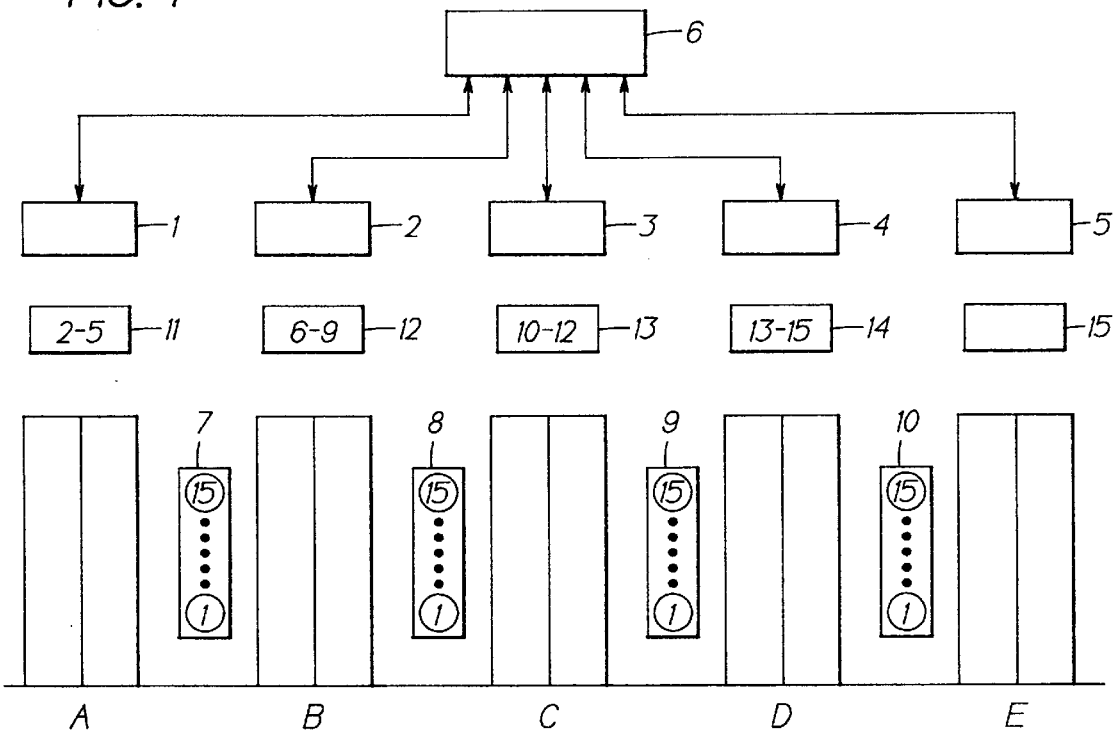
FIG. 1 is a block diagram showing an application example of a group-controlled elevator system according to the present invention.
Figure 3:
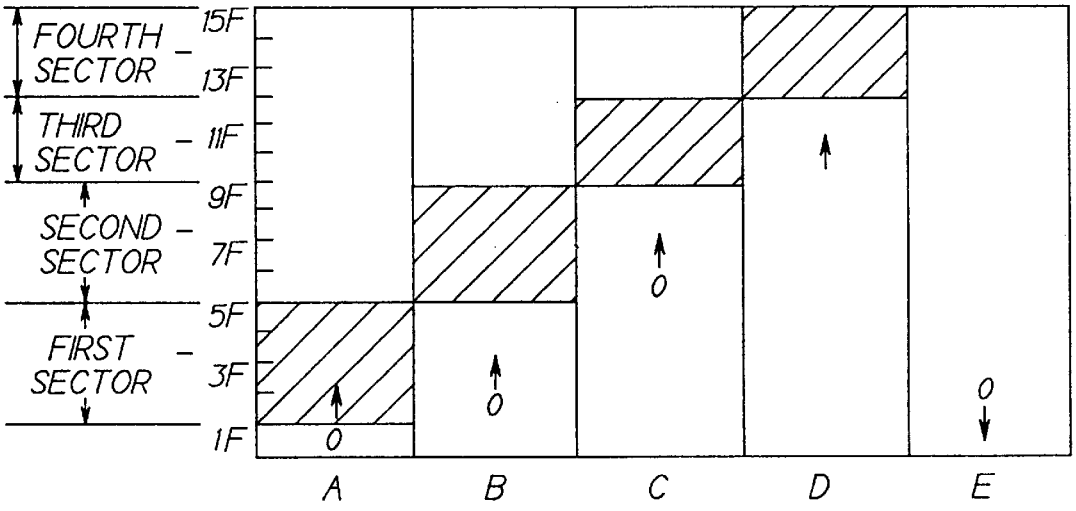
FIG. 3 is a diagram illustrating a group of sectors.
Figure 2:
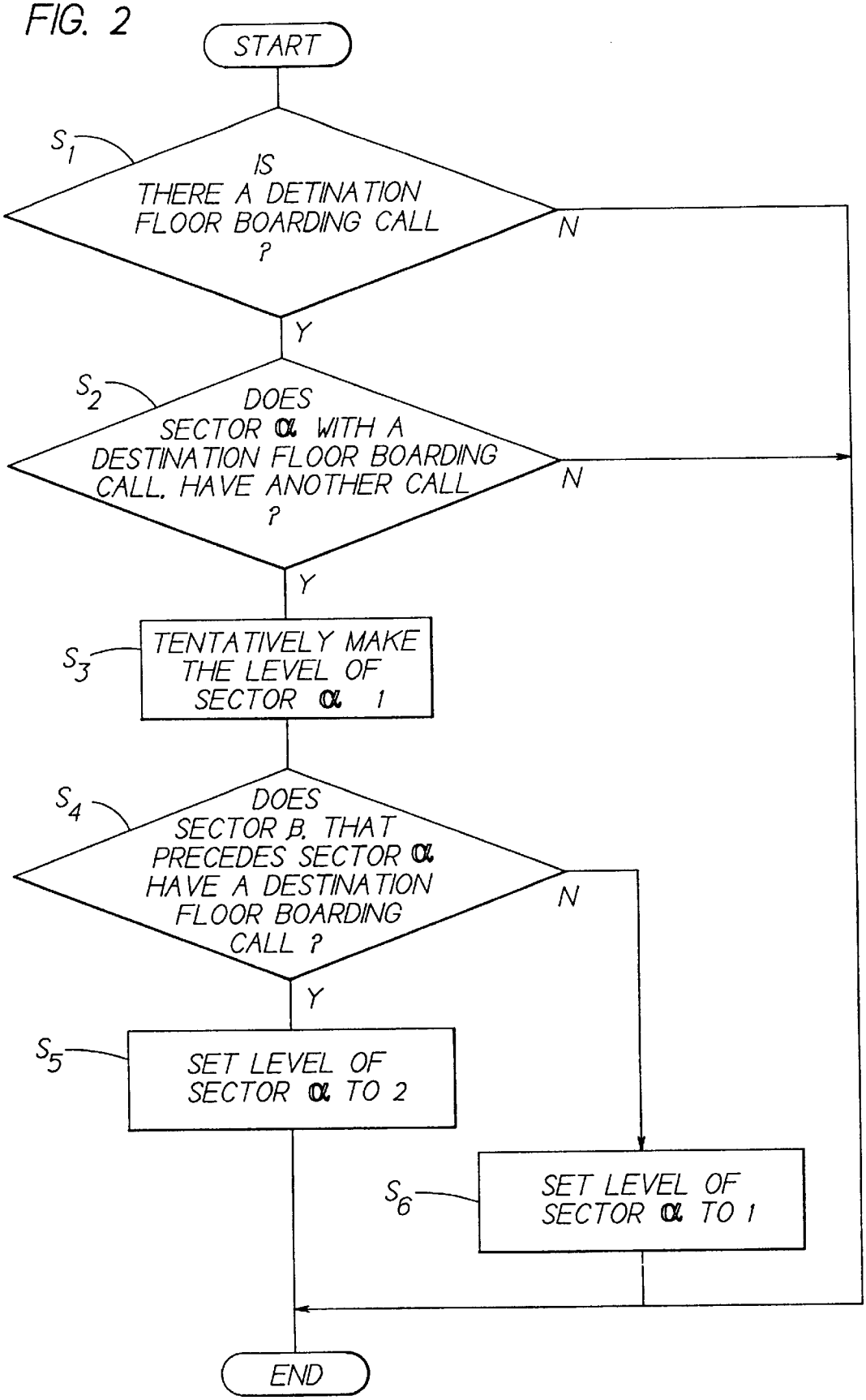
FIG. 2 is a flow chart showing an operation in accordance with the present invention.

Referring to FIG. 1, symbols (A), (B), (C), (D) and (E) are multiple elevators provided for a building. These elevators (A), (B), (C), (D) and (E) are equipped with car controllers (1), (2), (3), (4) and (5) for controlling the operation of their respective cars. Car position data and car call data are output to higher level controller (6) from car controllers (1), (2), (3), (4), and (5), and boarding call data for each elevator are also input to this higher level controller (6).

Higher level controller (6) calculates and processes the constantly changing positions and direction of movement of the cars, the circumstances of car calls and boarding calls, car load conditions, car departure interval conditions, and other types of traffic data to control movement of the cars in response to traffic demands, and assigns the most appropriate cars to floors where passengers are waiting. In addition, when it is determined that upper level controller (6) is in service, it performs group control in the peak demand mode, as described above.

From congested floors, such as the lobby floor, the cars will often be completely filled so that a large number of passengers may board. In this case. passengers at the back of the car may not be able to press the destination floor buttons on the car operating panel provided at the front of the car because of the passengers at the front. Therefore, on congested floors, such as the lobby floor, destination boarding location buttons which are the same as the destination floor buttons on the car operating panel, are provided at these boarding locations. When the destination floor boarding location buttons at these boarding locations are pressed, it will not be necessary to press the destination floor buttons on the car operating panels inside the cars.

On the lobby floor, destination floor boarding location buttons (7), (8), (9) and (10) are provided between elevators (A), (B), (C), (D) and (E). In addition, indicators (11), (12), (13), (14) and (15) that indicate the destination floor and that can be used when in service are provided above each elevator (A), (B), (C), (D) and (E).

First, when it is determined that higher level controller (6) is in service. operation is set to the peak demand mode.

Upper level controller (6) determines whether destination floor boarding location buttons (7), (8), (9) and (10) have been pressed on the lobby floor to produce a call (Step $S_1$). When destination floor boarding location button is pressed and the indicated destination floor belongs to sector α (one of either the first, second, third or fourth sectors), it is determined whether there is another destination floor boarding call for this sector α (Step $S_2$).

When a sector α has no other call, the priority level of sector α is tentatively made 1 (Step $S_3$). Next, it is determined if sector β (one of either the first, second, third or fourth sectors), with a priority level that precedes sector α, has a destination floor boarding call that belongs to this sector (Step $S_4$). When β already has a destination floor boarding call, the priority level of sector β becomes 1, and sector α is determined to be 2 (Step $S_5$). On the other hand, when sector β has no call, the priority level of sector α is determined to be 1 (Step $S_6$). In this way, the priority levels of sectors α and β are made 1 and 2 and the sector service order becomes the order in which destination floor boarding calls occur. In addition, when a car departs from the lobby floor to a destination floor that belongs to sector α, the priority level of sector β becomes 1.

Initially when the system is set to the peak demand mode, sector β will be the closest sector to the lobby floor. Thus, the destination floor boarding calls that occur first can be assigned priority level one. Note that cars (A), (B), (C) and (D), which reach the lobby in that order, will be responsible for the first, second, third and fourth sectors.

Thus, according to the present invention, when the peak demand mode is set, the sector service order will be the order in which each destination floor boarding call occurs, so that passengers on the lobby floor will not have to wait for a long period of time.

Various changes to the above description may be made without departing from the spirit and scope of the present invention as would be obvious to one of ordinary skill in the art of the present invention.

What is claimed is:

1. A group-controlled elevator system for controlling a plurality of elevator cars disposed in a building having a plurality of floors, said system comprising:

a destination floor input device for receiving destination calls;

a plurality of elevator controllers for controlling the operation of the plurality of elevator cars in response to the destination calls; and a group controller responsive to data provided by said plurality of elevator controllers such that the plurality of floors are formed into sectors and the plurality of elevator cars are dispatched to the sectors in response to the destination calls, characterized by the improvement comprising:

said group controller assigns each destination call to a sector, each sector being assigned a priority level for service by one of said elevator cars in the order in which said destination calls are made, said group controller, when a call to a floor in a given sector is registered, determining if said given sector has another call, and if not, determining if another sector, having a next-higher priority level than said given sector, has a call, and if so, assigning a priority level of one to said another sector and a priority level of two to said given sector, but if not, assigning a priority level of one to said given sector, whereby service is provided to the sectors in an order that corresponds to an order of the destination calls.

2. The group-controlled elevator system for controlling a plurality of elevator cars as recited in claim 1 wherein said group controller forms the sectors during a peak demand mode.

3. The group-controlled elevator system for controlling a plurality of elevator cars as recited in claim 1 wherein said group controller prioritizes each sector in accordance with the order of the destination calls.

4. The group-controlled elevator system for controlling a plurality of elevator cars as recited in claim 1 wherein said group controller prioritizes the sectors as an elevator car departs from a floor.

* * * * *